US009958825B2

(12) United States Patent
Abe et al.

(10) Patent No.: US 9,958,825 B2
(45) Date of Patent: May 1, 2018

(54) DRUM CARTRIDGE

(71) Applicant: BROTHER KOGYO KABUSHIKI KAISHA, Nagoya-shi, Aichi-ken (JP)

(72) Inventors: Koji Abe, Aichi (JP); Takashi Shimizu, Aichi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days. days.

(21) Appl. No.: 15/471,563

(22) Filed: Mar. 28, 2017

(65) Prior Publication Data

US 2018/0095420 A1 Apr. 5, 2018

(30) Foreign Application Priority Data

Sep. 30, 2016 (JP) ..... 2016-193212

(51) Int. Cl.
*G03G 21/16* (2006.01)
*G03G 21/18* (2006.01)

(52) U.S. Cl.
CPC ..... *G03G 21/1842* (2013.01); *G03G 21/1867* (2013.01); *G03G 2221/166* (2013.01)

(58) Field of Classification Search
CPC ..... G03G 15/80; G03G 21/1842; G03G 21/1846; G03G 21/1853; G03G 21/1867; G03G 2221/166
See application file for complete search history.

(56) References Cited

U.S. PATENT DOCUMENTS 9,423,769 B2 * 8/2016 Tanaka ..... G03G 21/1846
2007/0071481 A1 * 3/2007 Kamimura ..... G03G 15/0896 399/90
2008/0240774 A1 10/2008 Fukamachi et al.

FOREIGN PATENT DOCUMENTS

JP 2008-249802 A 10/2008

* cited by examiner

*Primary Examiner* — Hoang Ngo
(74) *Attorney, Agent, or Firm* — Merchant & Gould P.C.

(57) ABSTRACT

A drum cartridge, to which a developer cartridge containing toner therein and including a memory medium with an electric contact is detachably attached, is provided. The drum cartridge includes a photosensitive drum; a drum frame to receive the developer cartridge; a lock lever configured to lock the developer cartridge to the drum frame; a first drum contact configured to be in contact with the electric contact in a state where the developer cartridge is locked to the drum frame; and a spring configured to urge the first drum contact toward the electric contact. In the state where the developer cartridge is locked to the drum frame, the first drum contact is pressed toward the electric contact by an urging force of the spring.

19 Claims, 16 Drawing Sheets

FIG. 13A
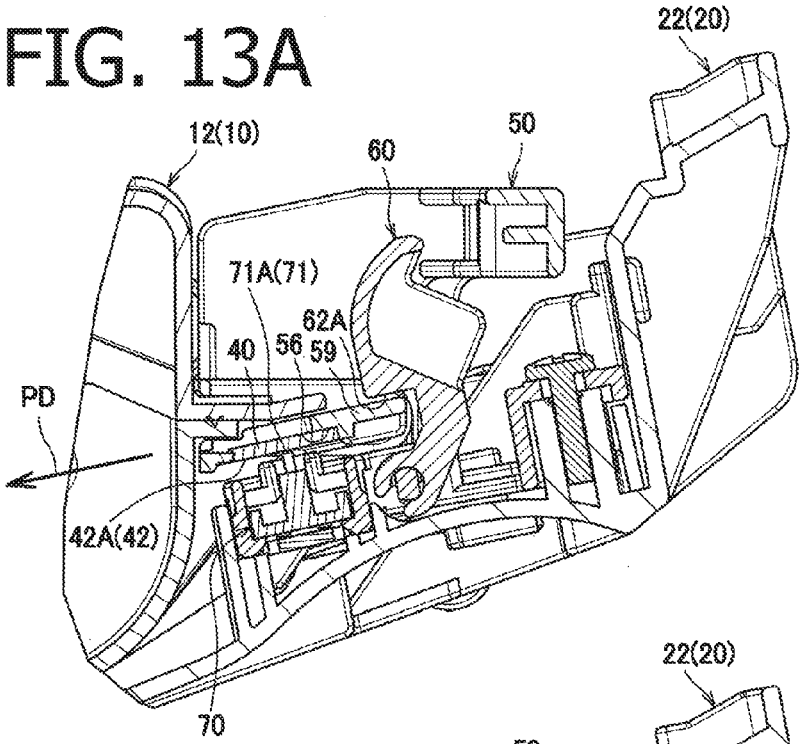
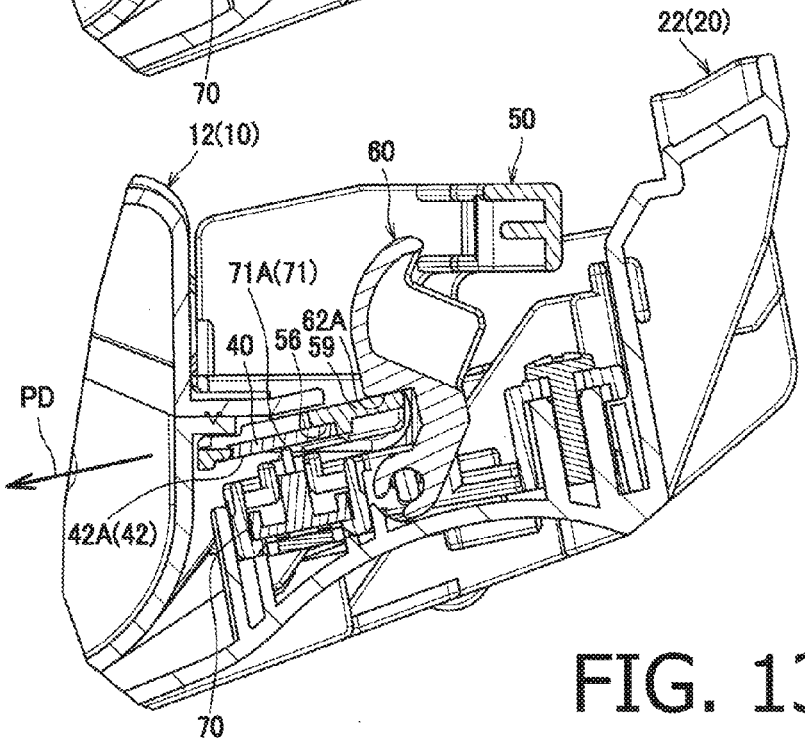
FIG. 13B

DRUM CARTRIDGE

CROSS REFERENCE TO RELATED APPLICATION

This application claims priority from Japanese Patent Application No. 2016-193212, filed on Sep. 30, 2016, the entire subject matter of which is incorporated herein by reference.

BACKGROUND

Technical Field

An aspect of the present disclosure is related to a drum cartridge, to which a developer cartridge is detachably attachable.

Related Art

A drum cartridge, to which a developer cartridge is detachably attachable, is known. The drum cartridge may include a first contact terminal, which is connectable with a terminal of a memory device in the developer cartridge, a second contact terminal, which is connectable with a terminal arranged in a main body of an apparatus, and a cable connected with the first contact terminal and the second contact terminal.

SUMMARY

In a case where a process cartridge, i.e., the drum cartridge being in a state where the developer cartridge is attached to the drum cartridge, is installed to the main body, the second contact terminal is in contact with the terminal of the main body. In a case where a driving force is input to a developer roller of the developer cartridge, a rotation moment is produced in the developer cartridge, and the terminal of the memory device can be urged against the first contact terminal by the rotation moment. Thus, contact between the terminal of the memory device and the first contact terminal in the drum cartridge can be maintained steadily.

In the meantime, condition of the contact between the terminal of the memory device and the first contact terminal in the drum cartridge, in a case where no driving force is input to the developer cartridge, has not necessarily been taken into consideration.

The present disclosure is advantageous in that a drum cartridge, in which contact between a contact terminal in a developer cartridge and a contact terminal in a drum cartridge is securely maintained, is provided.

According to an aspect of the present disclosure, a drum cartridge, to which a developer cartridge is detachably attached, the developer cartridge being configured to contain toner therein and including a memory medium including an electric contact, is provided. The drum cartridge includes a photosensitive drum; a drum frame configured to receive the developer cartridge; a lock lever configured to lock the developer cartridge to the drum frame; a first drum contact configured to be in contact with the electric contact in a state where the developer cartridge is locked to the drum frame; and a spring configured to urge the first drum contact toward the electric contact. In the state where the developer cartridge is locked to the drum frame, the first drum contact is pressed toward the electric contact by an urging force of the spring.

BRIEF DESCRIPTION OF THE ACCOMPANYING DRAWINGS

FIG. 13A is a cross-sectional view of a section including the lock lever, when a driving force is being input to the developer roller, according to the embodiment of the present disclosure. FIG. 13B is a cross-sectional view of the section including the lock lever, when substantially no driving force is being input to the developer roller, according to the embodiment of the present disclosure.

DETAILED DESCRIPTION

Hereinafter, a drum cartridge 20 to be detachably attached to a process cartridge 1 according to an embodiment of the present disclosure will be described with reference to the accompanying drawings.

Figure 1:
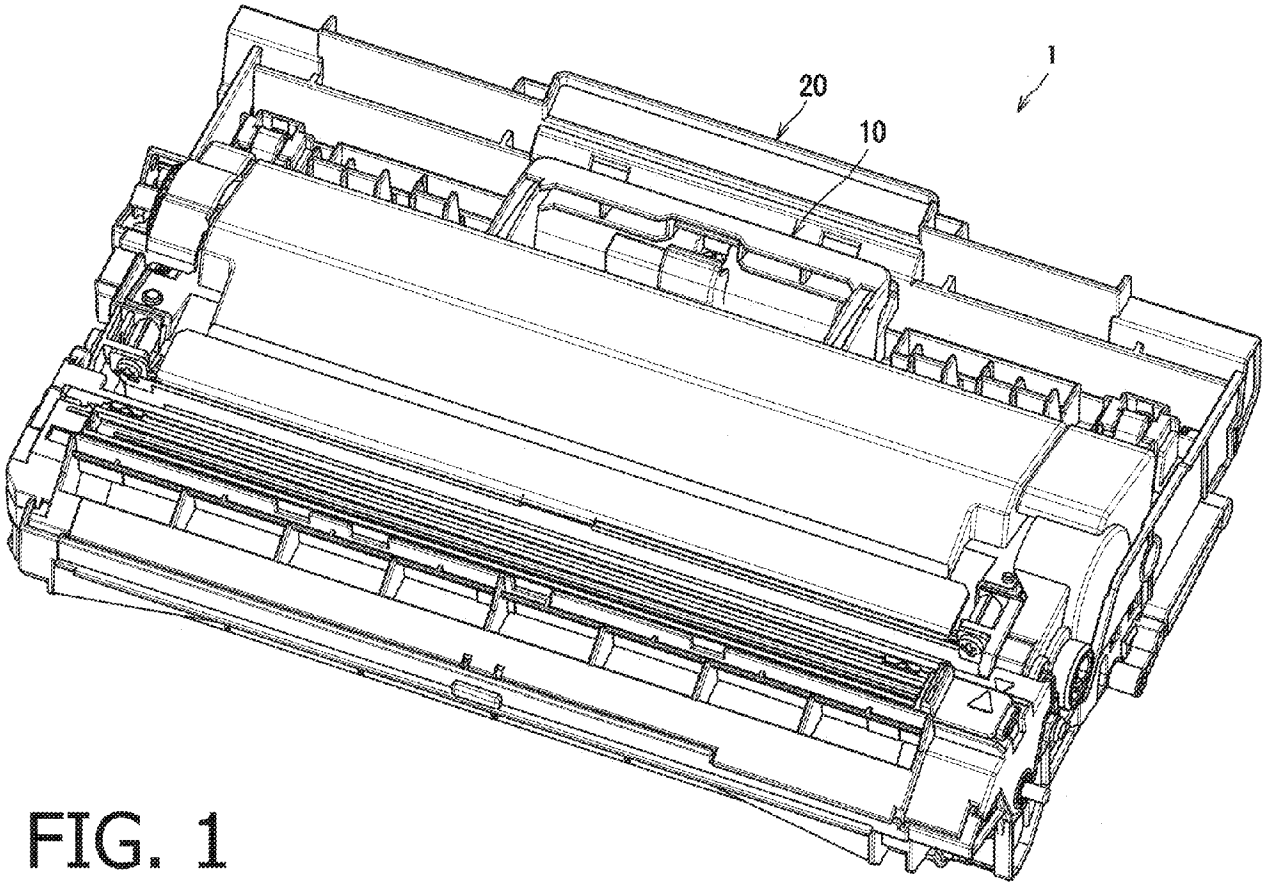
FIG. 1 is a perspective view of a process cartridge according to an embodiment of the present disclosure.

As shown in FIG. 1, the process cartridge 1 includes a developer cartridge 10 and the drum cartridge 20. The process cartridge 1 is attachable to and detachable from a main body of an image forming apparatus, which is not shown. The developer cartridge 10 may store toner therein and is attachable to and detachable from the drum cartridge 20.

Figure 2:
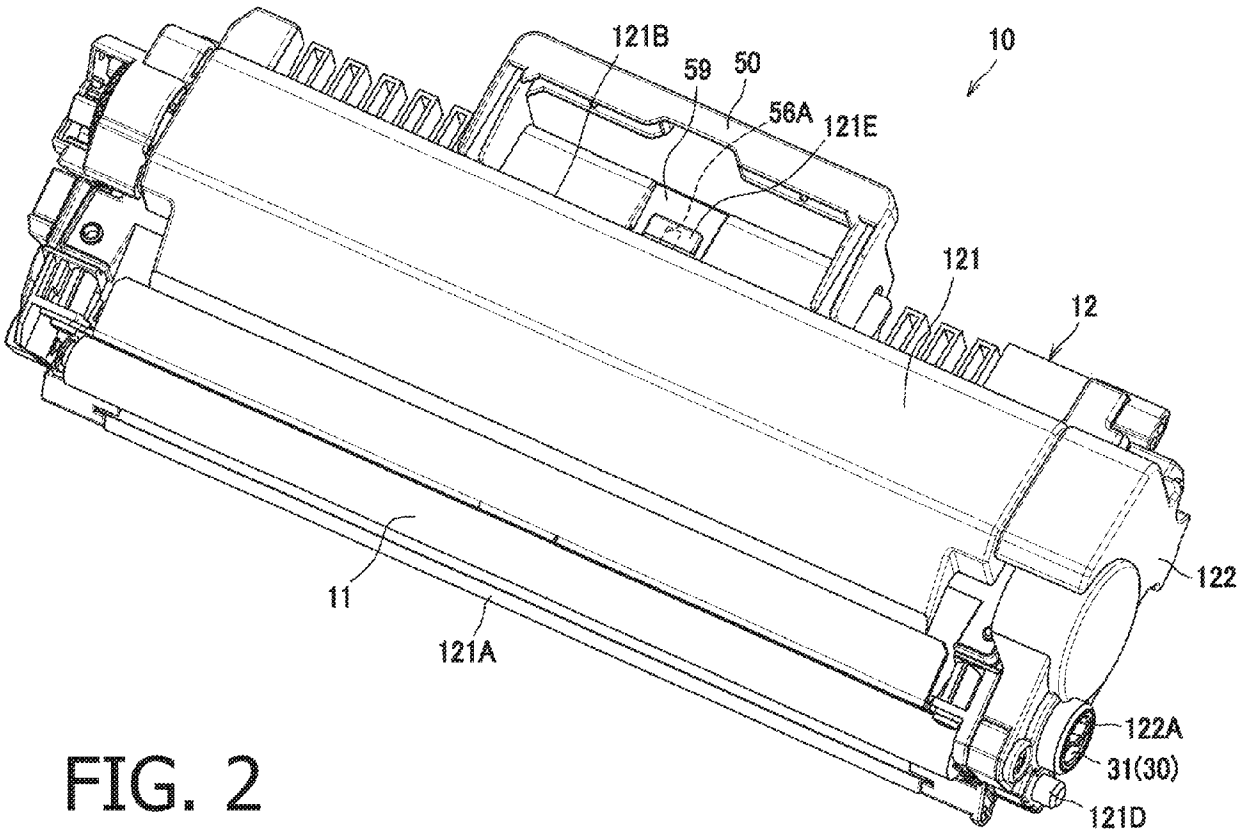
FIG. 2 is a downward perspective view of a developer cartridge according to the embodiment of the present disclosure.

As shown in FIG. 2, the developer cartridge 10 includes a developer roller 11 and a developer frame 12. The developer frame 12 is made of resin and includes a frame body 121, a gear cover 122, and a handle 50. The frame body 121 supports the developer roller 11 rotatably. The gear cover 122 covers a portion of a gear system 30 and is configured to transmit a driving force to the developer roller 11. The handle 50 may be gripped by a user.

The gear system 30 includes a coupling 31, to which the driving force from a power source mounted in the main body of the image forming apparatus may be input. The gear system 30 is configured to transmit the driving force input through the coupling 31 to the developer roller 11.

The frame body 121 has a form of a rectangular container box elongated along a direction of an axis of the developer roller 11. The frame body 121 is configured to contain toner therein. The frame body 121 includes one end side 121A, in which the developer roller 11 is arranged, and the other end side 121B, which is at an opposite side to the one end side 121A.

The developer roller 11 and a photosensitive drum 21 (see FIG. 12), which will be described later in detail, are arranged axially in parallel with each other. Therefore, in the following description, a term "axial direction" or "widthwise direction" may denote a direction of the axis of the developer roller 11 and an axis of the photosensitive drum 21. In the meantime, a term "one side with regard to the axial direction" or "leftward side" may denote one side of the frame body 121 along the axial direction, on which the gear cover 122 is arranged; and a term "the other side with regard to the axial direction" or "rightward side" may denote the opposite side of the frame body 121 along the axial direction to the gear cover 122.

Further, a term "first direction" or "front-rear direction" may denote a direction extending orthogonally to the axial direction and pointing from the one end side 121A toward the other end side 121B. A term "one side with regard to the first direction" or "frontward side" may denote one side along the first direction closer to the one end side 121A than the other end side 121B. A term "the other side with regard to the first direction" or "rearward side" may denote the other side along the first direction closer to the other end side 121B than the one end side 121A.

Furthermore, a term "second direction" or "vertical direction" may denote a direction orthogonal to the axial direction and to the first direction. A term "one side with regard to the second direction" or "upper side" may denote a side of the developer cartridge 10 along the second direction opposite to the drum cartridge 20. A term "the other side with regard to the second direction" or "lower side" may denote the other side of the developer cartridge 10 along the second direction closer to the drum cartridge 20.

On a lateral face at each side of the frame body 121 with regard to the widthwise direction, arranged is a guided part 121D. The guided part 121D has a cylindrical form that protrudes in the widthwise direction from the lateral face of the frame body 121. The guided parts 121D are arranged coaxially with the axis of the developer roller 11.

The gear cover 122 is arranged at a leftward side of the frame body 121. The gear cover 122 has an opening 122A, through which the coupling 31 may be exposed outside.

Figure 3:
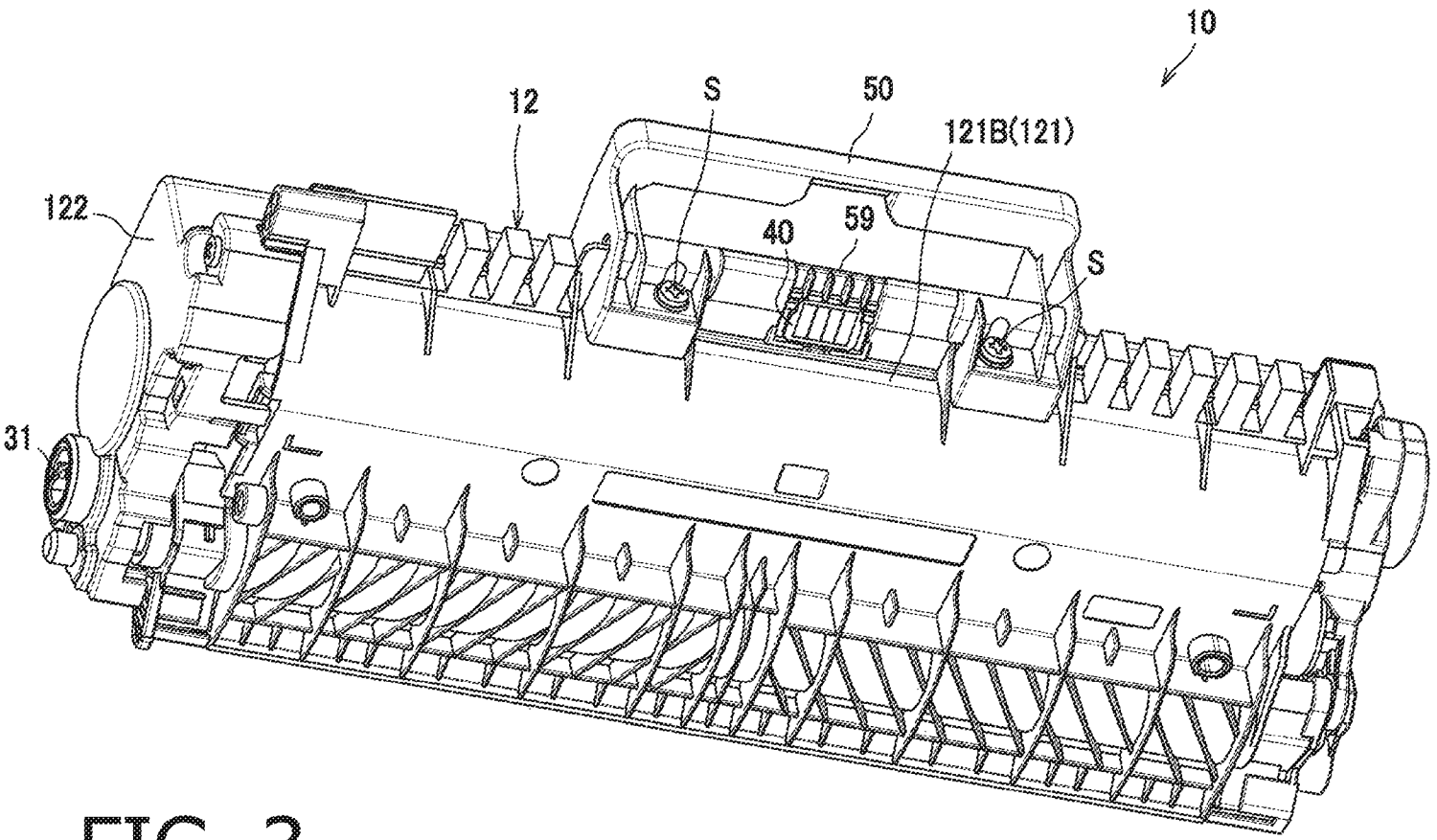
FIG. 3 is an upward perspective view of the developer cartridge according to the embodiment of the present disclosure.
Figure 5:
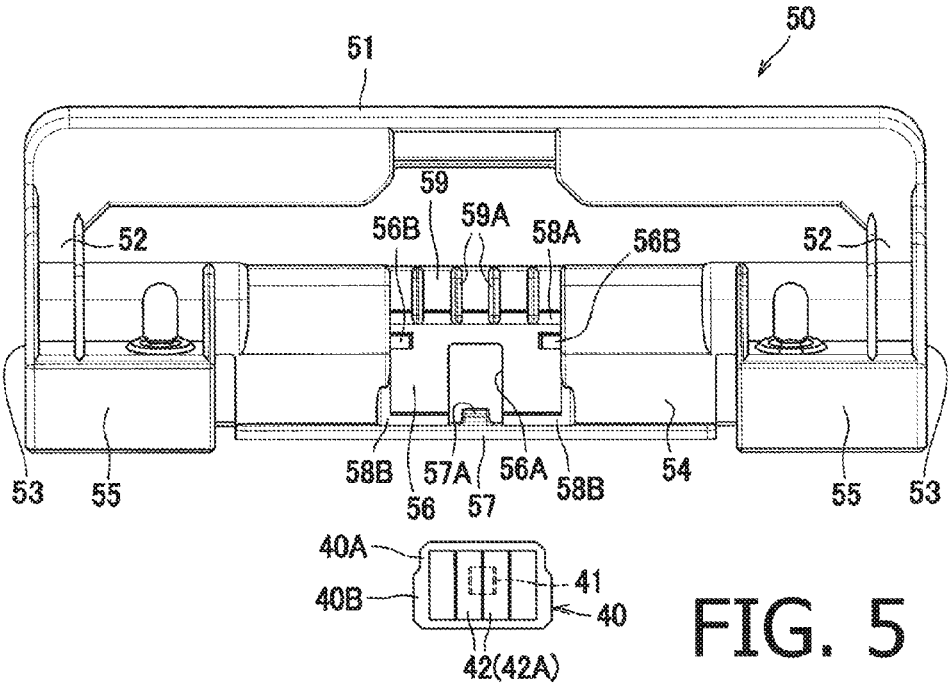
FIG. 5 is a bottom plan view of the handle attachable to the developer cartridge according to the embodiment of the present disclosure.

As shown in FIG. 3, the handle 50 is detachably attached to the frame body 121 through screws S. The handle 50 includes a first substrate 40, to which a chip 41 (see FIG. 5) is attached.

Figure 4:
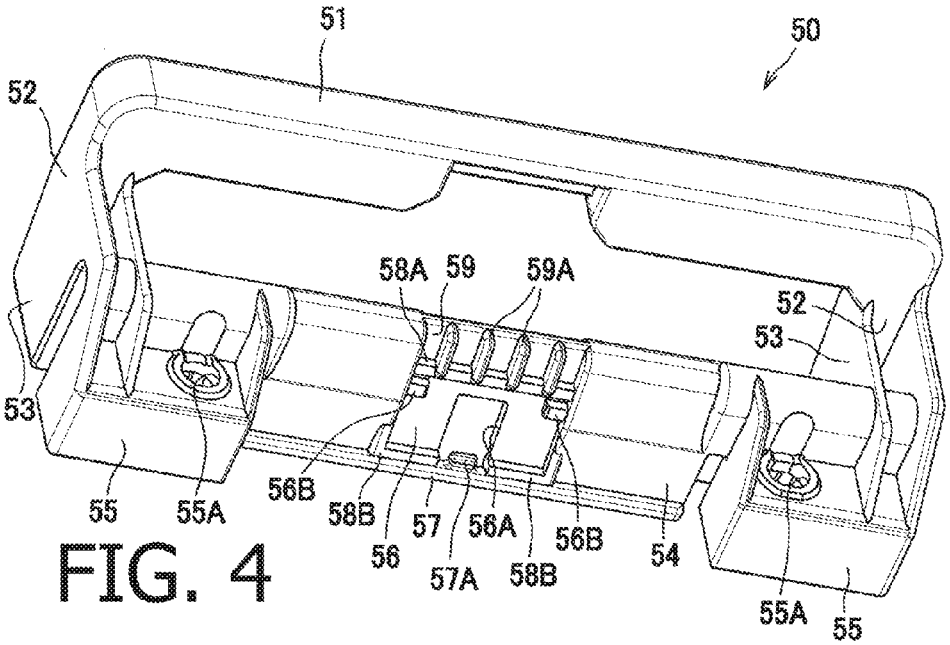
FIG. 4 is an upward perspective view of a handle attachable to the developer cartridge according to the embodiment of the present disclosure.

As shown in FIG. 4, the handle 50 includes a gripper 51, two (2) extended parts 52, two (2) lateral walls 53, and a connector part 54. The gripper 51 longitudinally extends in the widthwise direction. The extended parts 52 extend frontward from widthwise ends of the gripper 51. The lateral walls 53 extend downward from the extended parts 52. The connector part 54 connects lower ends of the lateral walls 53.

The connector part 54 includes two (2) protrusive parts 55, which protrude downward at the widthwise ends of the connector part 54. Each protrusive part 55 has a through hole 55A, through which the screw S to fasten the handle 50 to the frame body 121 is inserted. Each through hole 55A is formed through the protrusive part 55 to make a passage in the front-rear direction.

The connector part 54 is formed to have a stepped shape, of which heights in the vertical direction are reduced to be smaller as the connector part 54 extends inward from outer sides along the widthwise direction. Therefore, a widthwise central area in the connector part 54 is thinnest in the vertical direction among other widthwise areas in the connector part 54.

The connector part 54 includes a supporting part 56, on which the first substrate 40 (see FIG. 5) is supported, in the widthwise central area. The first substrate 40 includes the chip 41 including a memory device and a plurality of electric contacts 42, which are connected with the chip 41.

The chip 41 is arranged on an upper surface of the first substrate 40. The electric contacts 42 are arranged on a lower surface of the first substrate 40. The electric contacts 42 are in shapes of thin and rectangular bars. The electric contacts 42 are arranged to be spaced apart slightly from one another along the widthwise direction. A lower surface of each electric contacts 42 includes a contact surface 42A, which is configured to be in contact with one of first drum contacts 71A (see FIG. 9).

The first substrate 40 includes a smaller-width section 40A, which has a predetermined width along the widthwise direction, and a larger-width section 40B, of which width along the widthwise direction is larger than the smaller-width region 40A. A dimension of the smaller-width section 40A along the front-rear direction is smaller than a dimension of the larger-width section 40B along the front-rear direction. The smaller-width section 40A is arranged rearward with respect to the larger-width section 40B.

The supporting part 56 includes a surface that spreads orthogonally to the vertical direction and faces downward. The supporting part 56 is provided in a central area in the connector part 54 with regard to the widthwise direction and in a range between a frontward end and a central area with regard to the front-rear direction in the connector part 56.

At a widthwise central area in the supporting part 56, formed through is an opening 56A. Dimensions of the opening 56A in the front-rear direction and the widthwise direction are larger than dimensions of the chip 41 in the front-rear direction and the widthwise direction. In a state where the supporting part 56 supports the first substrate 40 thereon, the chip 41 stays inside the opening 56A. Meanwhile, in a case where the handle 50 is attached to the frame body 121, as shown in FIG. 2, the opening 56A is covered by a cover 121E, which is formed in the frame body 121, from above.

Referring back to FIG. 5, on a rearward side in the supporting part 56, arranged are two (2) projections 56B, which may flank the smaller-width section 40A of the first substrate 40 along the widthwise direction. The projections 56B project downward from the lower surface of the supporting part 56. The projections 56B may prevent the first substrate 40 from being attached to the supporting part 56 in a contrary orientation with regard to the front-rear direction.

On a frontward side of the supporting part 56, formed is an elongated rib 57 longitudinally extending along the widthwise direction. The elongated rib 57 connects parts that are arranged at both sides of the supporting part 56 along the widthwise direction with each other. The elongated rib 57 includes an engageable claw 57A, which is engageable with a frontend portion of the first substrate 40, at a widthwise central position.

The engageable claw 57A protrudes rearward from the elongated rib 57. The engageable claw 57A is arranged at a position offset downward from the supporting part 56 for an amount substantially equivalent to a thickness of the substrate 40.

The supporting part 56 further includes a first retainer rib 58A and a second retainer rib 58B, which are arranged on a rearward side and a frontward side in the supporting part 56 respectively, to interpose and retain the first substrate 40 in there-between along the front-rear direction. The first retainer rib 58A extends between one widthwise end and the other widthwise end of the supporting part 56 along the widthwise direction.

The second retainer rib 58B is arranged at each widthwise side, i.e., on a leftward side and a rightward side, of the engageable claw 57A. Each second retainer rib 58B extends along a front edge of the supporting part 56, from a side closer to the engageable claw 57A outward along the widthwise direction to be farther from the engageable claw 57A, and turns rearward at the widthwise end of the supporting part 56.

At a rearward position with respect to the first retainer rib 58A in a widthwise central area in the connector part 54, formed is an engagement part 59, which is engageable with a lock lever 60 (see FIG. 6) described below. On a lower surface of the engagement part 59, formed are a plurality of enhancing ribs 59A, which protrude downward. The enhancing ribs 59A longitudinally extends along the front-rear direction and are spaced apart along the widthwise direction from one another. The enhancing ribs 59A are connected with the first retainer rib 58A at frontends thereof.

Figure 6:
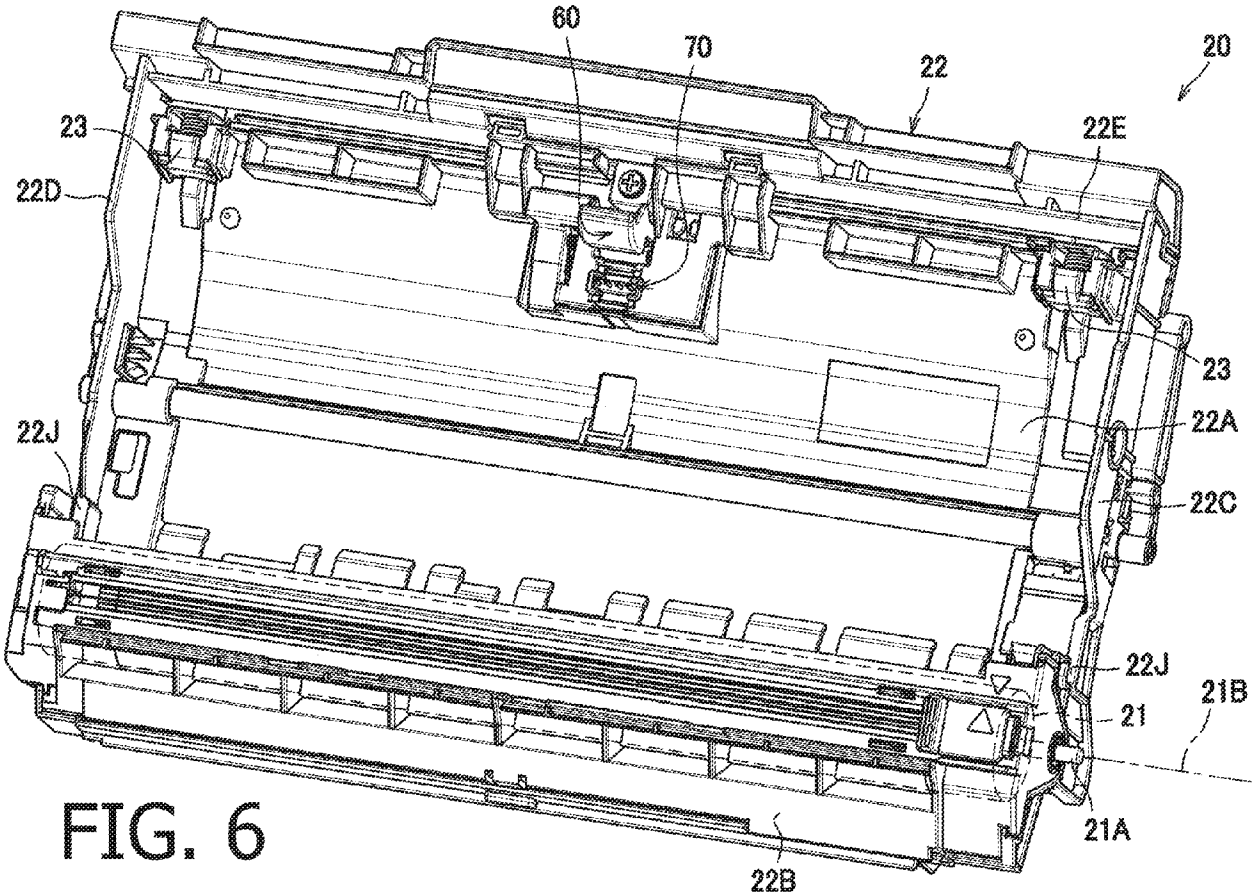
FIG. 6 is a downward perspective view of a drum cartridge according to the embodiment of the present disclosure.

The drum cartridge 20 includes, as shown in FIG. 6, the photosensitive drum 21, a drum frame 22, a presser member 23, a lock lever 60, and a spring-pin connector 70. The drum frame 22 may be made of resin and supports the photosensitive drum 21. The developer cartridge 10 described above may be detachably attached to the drum frame 22. The presser member 23 includes two (2) presser members 23, which may press the developer cartridge 10 against the photosensitive drum 21. The lock lever 60 may lock the developer cartridge 10 to the drum cartridge 20. The spring-pin connector 70 is arranged to contact the electrical contacts 42 in the developer cartridge 10.

The photosensitive drum 21 includes a rotation shaft 21A. The rotation shaft 21A is rotatable about a rotation axis 21B and axially extends in the widthwise direction.

The drum frame 22 includes a bottom wall 22A, which is in a rectangular form in a plan view, and side walls 22B, 22C, 22D, 22E, which rise upward from edges of the bottom wall 22A. The side walls 22C, 22D at the leftward and rightward edges of the bottom wall 22A face each other along the widthwise direction. Each of the side walls 22C, 22D includes a guide groove 22J configured to guide and rotatably support the guided part 121D in the developer cartridge 10. At a rearward end of the bottom wall 22A, arranged are the lock lever 60, the spring-pin connector 70, and the presser members 23.

In other words, the drum frame 22 includes one end side, at which the photosensitive drum 21 is arranged, and the other end side opposite to the one end side, in which the lock lever, the spring-pin connector 70, and the presser members 23 are arranged. The one end side of the drum frame 22 may refer to a section in a predetermined range from a frontward edge of the drum frame 22, and the other end side of the drum frame 22 may refer to a section in a predetermined range from a rearward edge of the drum frame 22. In this regard, a direction pointing from the one end side toward the other end side in the drum frame 22 may correspond to the first direction and the front-rear direction mentioned above.

The presser members 23 are each arranged at one side of the bottom wall 22A and at the other side of the bottom wall 22A opposite to the one side with regard to the widthwise direction. Meanwhile, the lock lever 60 and the spring-pin connector 70 are arranged in a widthwise central area on the bottom wall 22A.

Figure 7:
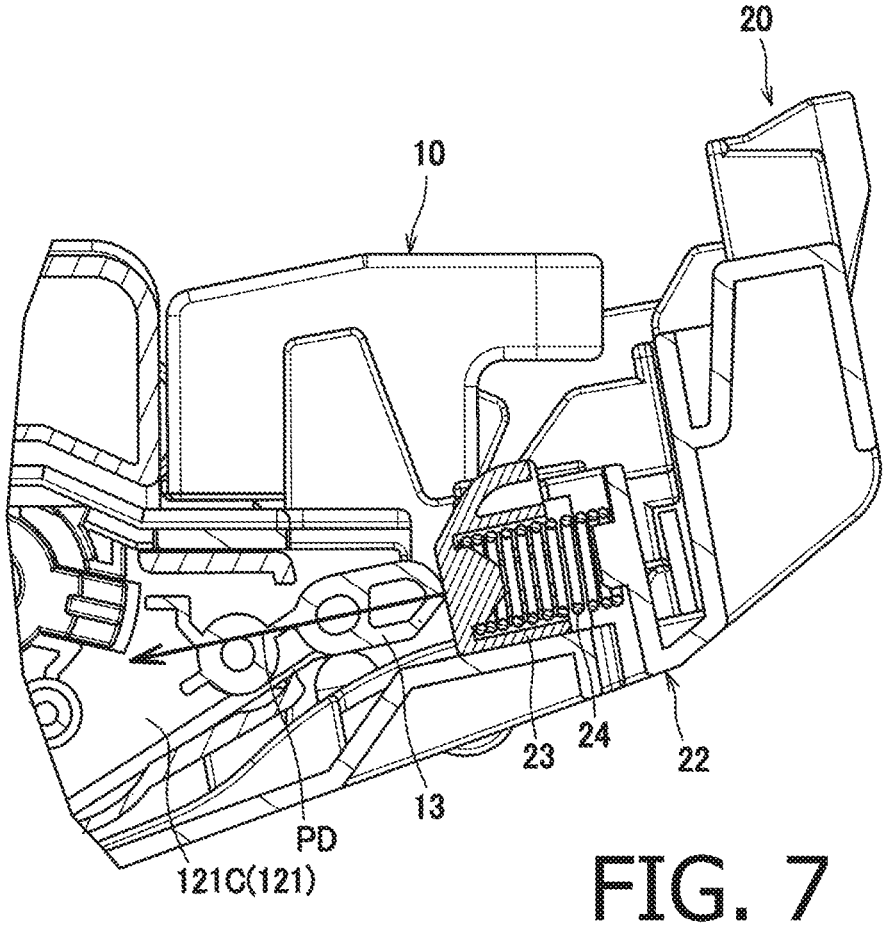
FIG. 7 is an enlarged cross-sectional view of a section including a presser member in the drum cartridge according to the embodiment of the present disclosure.

As shown in FIG. 7, the presser members 23 are urged toward the photosensitive drum 21 (see also FIG. 12) by presser springs 24, which are arranged at the drum frame 22. The presser member 23 may, when the developer cartridge 10 is locked to the drum cartridge 20, urge pressurized sections 13, which are arranged in the developer cartridge 10, to urge the developer roller 11 (see also FIG. 12) against the photosensitive drum 21 along a pressing direction PD, which extends along an axis of the presser spring 24. The pressurized section 13 is arranged at a rearward end on a rightward side and a leftward side of the side wall 121C in the developer cartridge 11.

Figure 8:
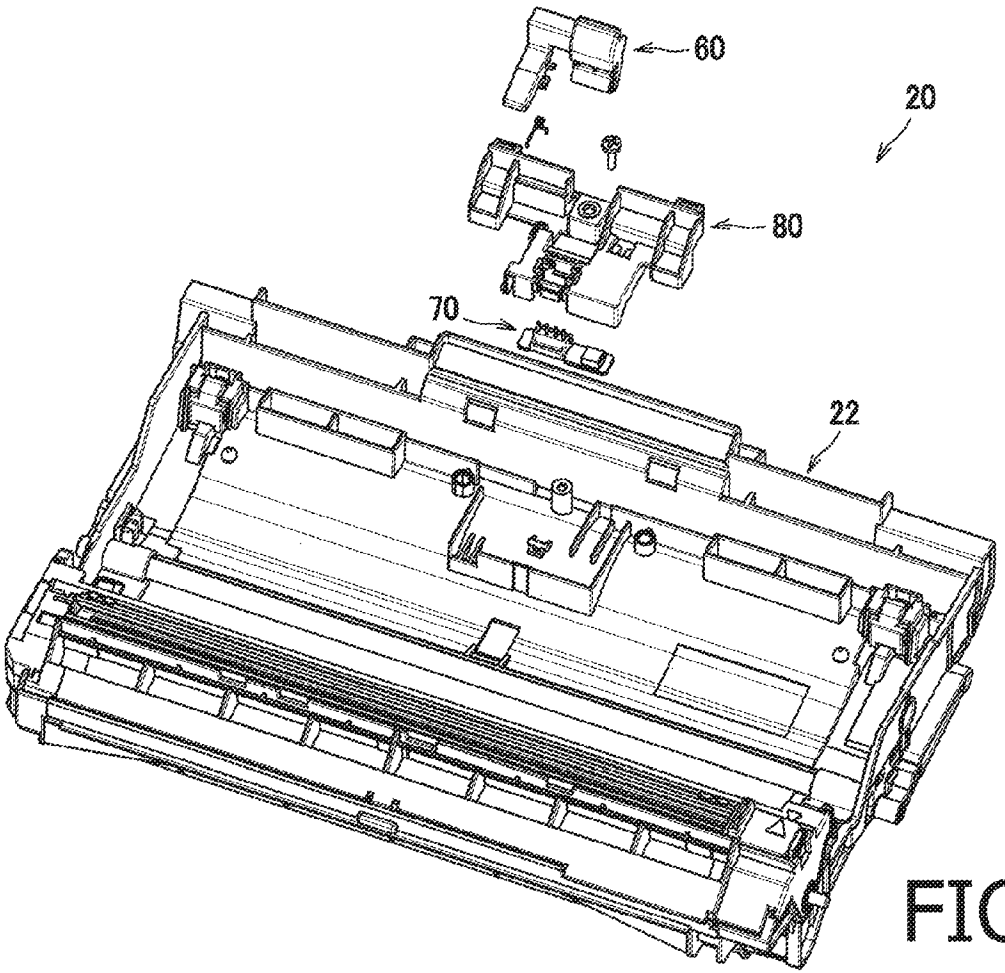
FIG. 8 is an exploded view of a drum frame, a lock lever, a holder, and a spring-pin connector for the drum cartridge according to the embodiment of the present disclosure.
Figure 9:
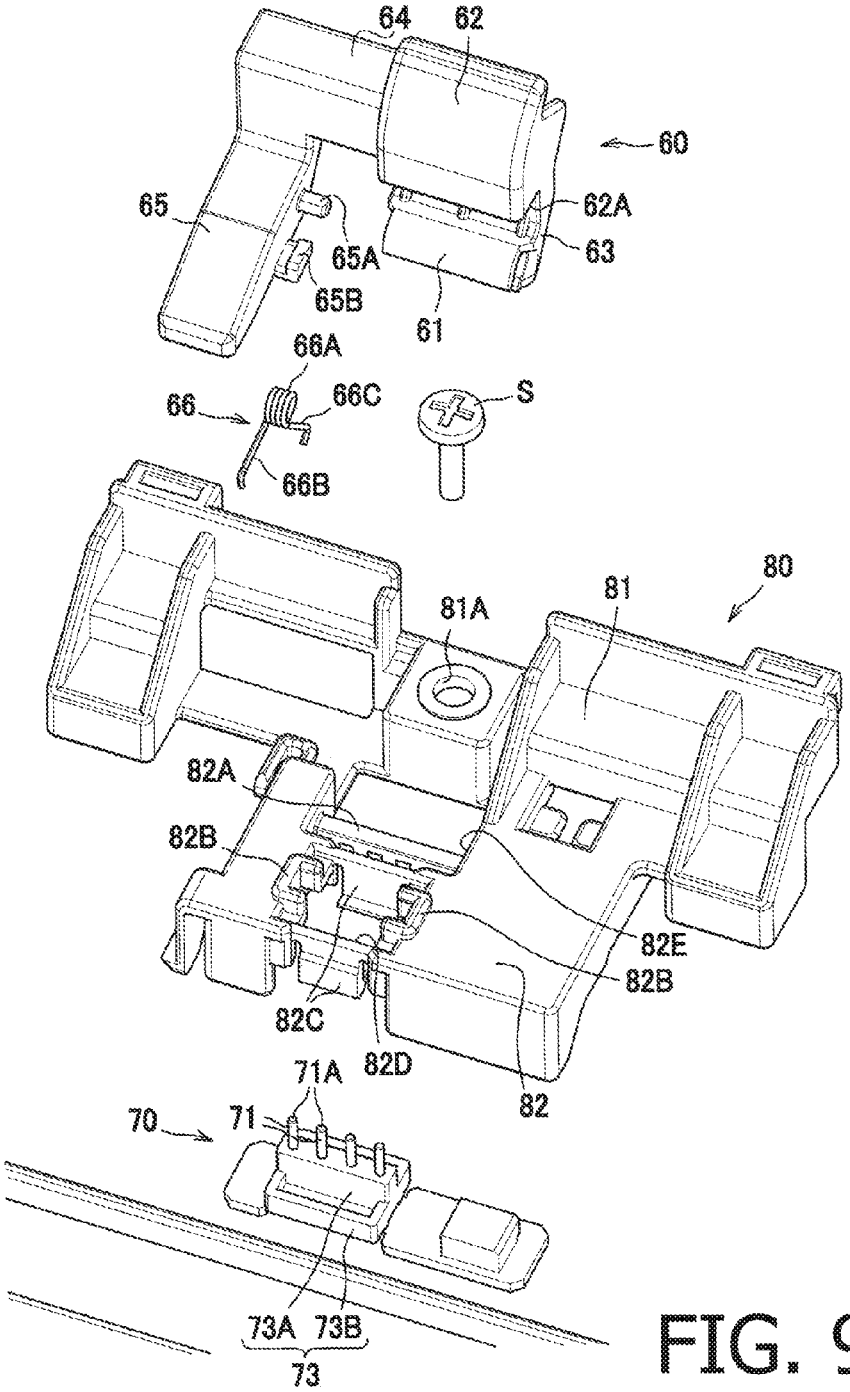
FIG. 9 is an enlarged exploded view of the lock lever, the holder, and the spring-pin connector for the drum cartridge according to the embodiment of the present disclosure.

As shown in FIG. 8, the lock lever 60 and the spring-pin connector 70 are arranged at the drum frame 22 via a holder 80. As shown in FIG. 9, the holder 80 includes a first part 81, which longitudinally extends in the widthwise direction, and a second part 82, which protrudes frontward from a widthwise central area of the first part 81.

In the widthwise central area in the first part 81, formed is a hole 81A, through which a screw S to fasten the holder 80 to the drum frame 22 may be inserted. The second part 82 includes a shaft 82A, two (2) retainer sections 82B, and two (2) supporting sections 82C. The shaft 82A may support the lock lever 60 rotatably. The retainer sections 82B may retain the spring-pin connector 70 from widthwise sides and front-rear sides. The supporting sections 82C may support the spring-pin connector 70 from below. The second part 82 further includes a rectangular hole 82D, through which a plurality of first drum contacts 71A arranged on the spring-pin connector 70 are exposed to access the electrical contacts 42, and a rectangular mobility room 82E, in which the shaft 82A is arranged.

The hole 82D is located at a frontward position with respect to the mobility room 82E. The hole 82D has a dimension in the widthwise direction, i.e., a width, which is substantially equal to a width of the mobility room 82E. The shaft 82A is formed to longitudinally extend between a leftward inner wall and a rightward inner wall of the mobility room 82E.

The retainer sections 82B are arranged on a leftward edge and a rightward edge of the hole 82D. Each retainer section 82B is formed to have an approximate shape of a U or C in a plan view. The retainer sections 82B are spaced apart along the widthwise direction from each other.

A leftward one of the retainer sections 82B may be arranged over a leftward part of the spring-pin connector 70, more specifically, over a base 73A of a housing 73 in the spring-pin connector 70, to cover from the front, the left, and the rear, to retain a leftward end portion of the spring-pin connector 70. A rightward one of the retainer sections 82B may be arranged over a rightward part of the spring-pin connector 70, more specifically, over the base 73A of the housing 73 in the spring-pin connector 70, to cover from the front, the right, and the rear, to retain a rightward end portion of the spring-pin connector 70.

The supporting sections 82C extend downward from a frontward edge and a rearward edge of the hole 82D in the second part 82 and turn inward, i.e., toward a center of the hole 82D, in the front-rear direction. The supporting sections 82C may support a flange 73B in a housing 73 of the spring-pin connector 70, which will be described later in detail, from below.

The lock lever 60 includes a bearing 61, a hook section 62, a connector section 63, an extended section 64, and a lifting section 65. The bearing 61 is rotatably engageable with the shaft 82A. The hook section 62 is engageable with the engagement part 59 (see also FIG. 3) in the developer cartridge 10. The connector section 63 connects the bearing 61 and the hook section 62. The extended section 64 extends rightward from the connector section 63. The lifting section 65 extends downward from the extended section 64 and turns frontward.

The hook section 62 protrudes frontward from the connector section 63. A lower face of the hook section 62 includes a contact part 62A, which may contact the engageable part 59 in the developer cartridge 10 in a case where the developer cartridge 10 is locked to the drum cartridge 20.

The lock lever 60 is movable to pivot about the shaft 82A between a locking position and a releasing position. In a case where the lock lever 60 is in the locking position, the developer cartridge 10 is locked to the drum cartridge 20, or more specifically, to the drum frame 22; and in a case where the lock lever 60 is in the releasing position, the developer cartridge 10 is releasable from the drum cartridge 20, or more specifically, from the drum frame 22. In a case where the lock lever 60 is moved from the locking position to the releasing position, a tip end of the lifting section 65 may move to be farther from the bottom wall 22A of the drum frame 22 to uplift the developer cartridge 10 to be separated farther from the bottom plate 22A. In this regard, a state where the developer cartridge 10 is locked to the drum cartridge 20 may mean a state, in which the developer cartridge 10 is attached to the drum cartridge 20 and the lock lever 60 is in the locking position. Thus, the lock lever 60 can restrict the developer cartridge 10 from being separated from the drum cartridge 10 in a case where in the locking position by placing the contact part 62A to contact the developer cartridge 10.

In a position between the lock lever 60 and the holder 80, arranged is a torsion spring 66 to urge the lock lever 60 toward the locking position. In a case where the lock lever 60 in the locking position, a portion of the lock lever 60 is engaged with at least one of the holder 80 and the drum frame 22. The torsion spring 66 includes a coil 66A, a first arm 66B, and a second arm 66C. The first arm 66B extends outward in a radial direction of the coil 66A from one end of the coil 66A, and the second arm 66C extends outward in a radial direction of the coil 66A from the other end of the coil 66A.

The lifting section 65 includes a supporting protrusion 65A and a spring hook 65B. The supporting protrusion 65A supports an inner circumference of the coil 66A. The spring hook 65B is engaged with the first arm 65B. The supporting protrusion 65A and the spring hook 65B protrude leftward from a leftward surface of the lifting section 65. The spring hook 65B is located at a frontward position with respect to the supporting protrusion 65A. Meanwhile, the second arm 66 in the torsion spring 66 is engageable with a spring hook (not shown), which is arranged at the holder 80.

Figure 10:
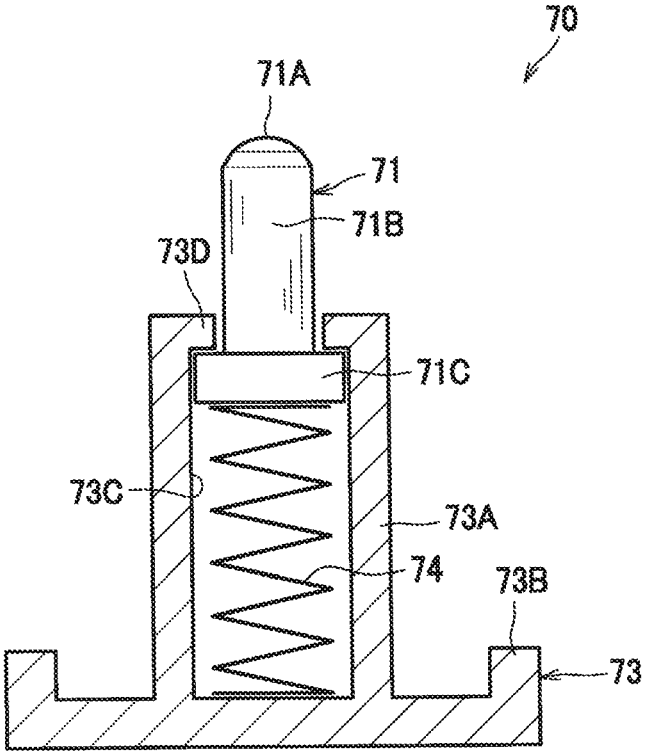
FIG. 10 is a cross-sectional view of the spring-pin connector for the drum cartridge according to the embodiment of the present disclosure.

As shown in FIGS. 9 and 10, the spring-pin connector 70 includes a plurality of pins 71, a plurality of coil springs 74, and the housing 73 to support the pins 71 and the coil springs 74. The pins 71, the coil springs 74, and the housing 73 may be made of a conductive material such as metal. The pins 71, the coil springs 74, and the housing 73 are electrically connectable with one another.

Each of the pins 71 includes a cylinder 71B and a flange 71C. The cylinder 71B longitudinally extend in the vertical direction. The flange 71C expands outward in a radial direction of the cylinder 71B from a lower end of the cylinder 71B. An upper end portion of the cylinder 71B is thinned to point upward. The thinned upper end portion of the cylinder 71B forms the first drum contact 71A, which may contact one of the electrical contacts 42.

The housing 73 includes a base 73A and a flange 73B. The base 73A has a rectangular form elongated in the widthwise direction. The flange 73B extends frontward and rearward from a lower end of the base 73A. The base 73A includes a plurality of tubular rooms 73C to accommodate the pins 71 and the coil springs 74. A quantity of the tubular rooms 73C is equal to a quantity of the pins 71 in the spring-pin connector 70. The tubular rooms 73C are, with the pins 71 and the coil springs 74 accommodated therein, arranged to be spaced apart along the widthwise direction from one another. At an upper end of each tubular room 73C, formed is a stopper 73D, which extends inward in a radial direction from the upper end of the tubular room 73C, so that the pin 71 and the coil spring 74 can be prevented from hopping out. The stopper 73C can contact the flange 71 of the pin 71 along an axial direction of the pin 71.

Each coil spring 74 is arranged between the pin 71 and a bottom of the tubular room 73C. The coil spring 74 urges the pin 71 so that the tip end of the pint 71, i.e., the first drum contact 71A, may point at the electric contact 42. Thus, the coil spring 74 urges the pin 71 along a direction, in which the cylinder 71B extends.

Figure 11:
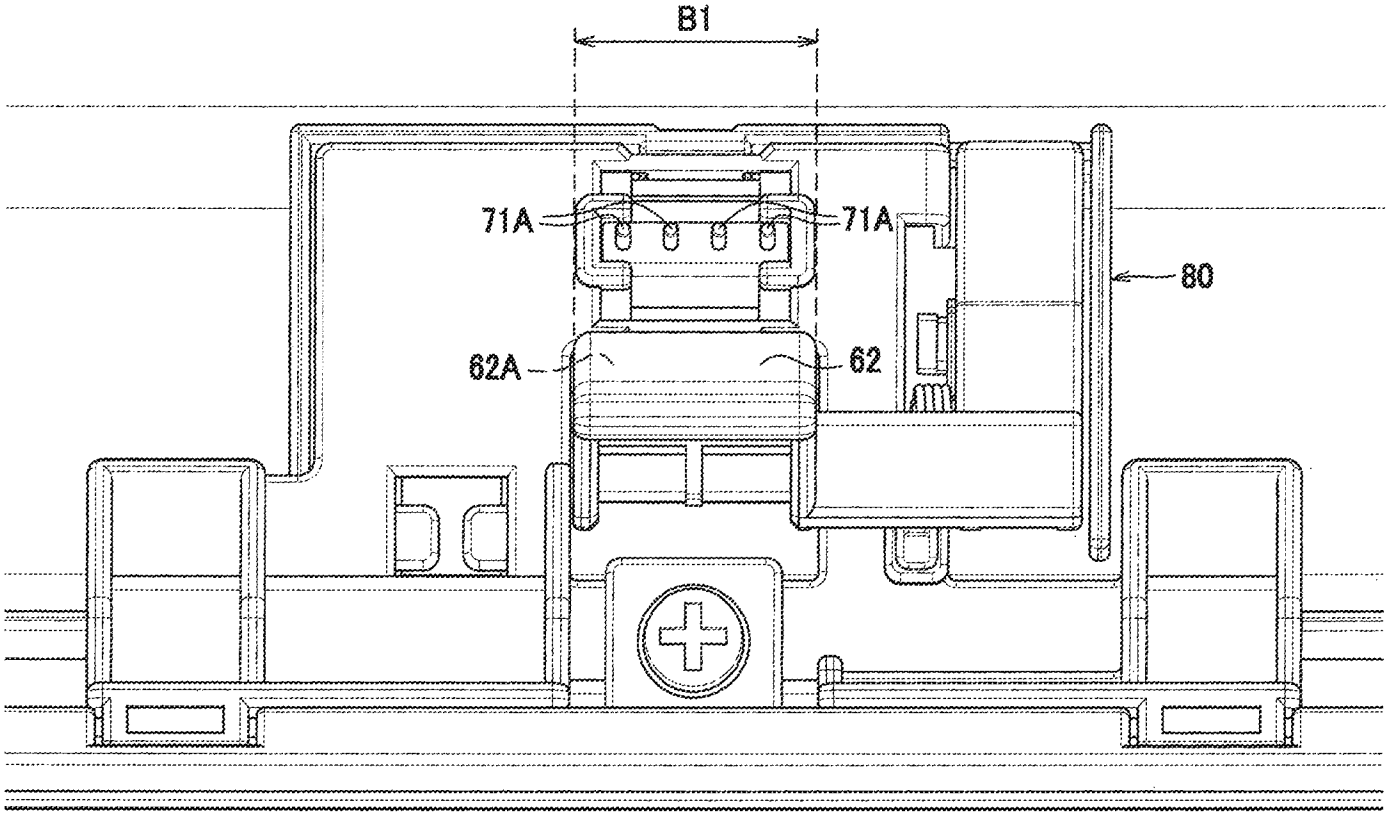
FIG. 11 is a plan view to illustrate arrangement of a first drum contact and a contact part in the lock lever for the drum cartridge according to the embodiment of the present disclosure.

As shown in FIG. 11, the first drum contacts 71A are arranged with regard to the widthwise direction within a width range B1 of the contact part 62A of the lock lever 60. A portion of the first drum contacts 71A that are at the left side, e.g., two of the first drum contacts 71A at the left side, and the other portion of the drum contacts that are at the right side, e.g., two of the first drum contacts 71A at the right side, are arranged at symmetrical position across a widthwise center of the contact part 62A.

Figure 12:
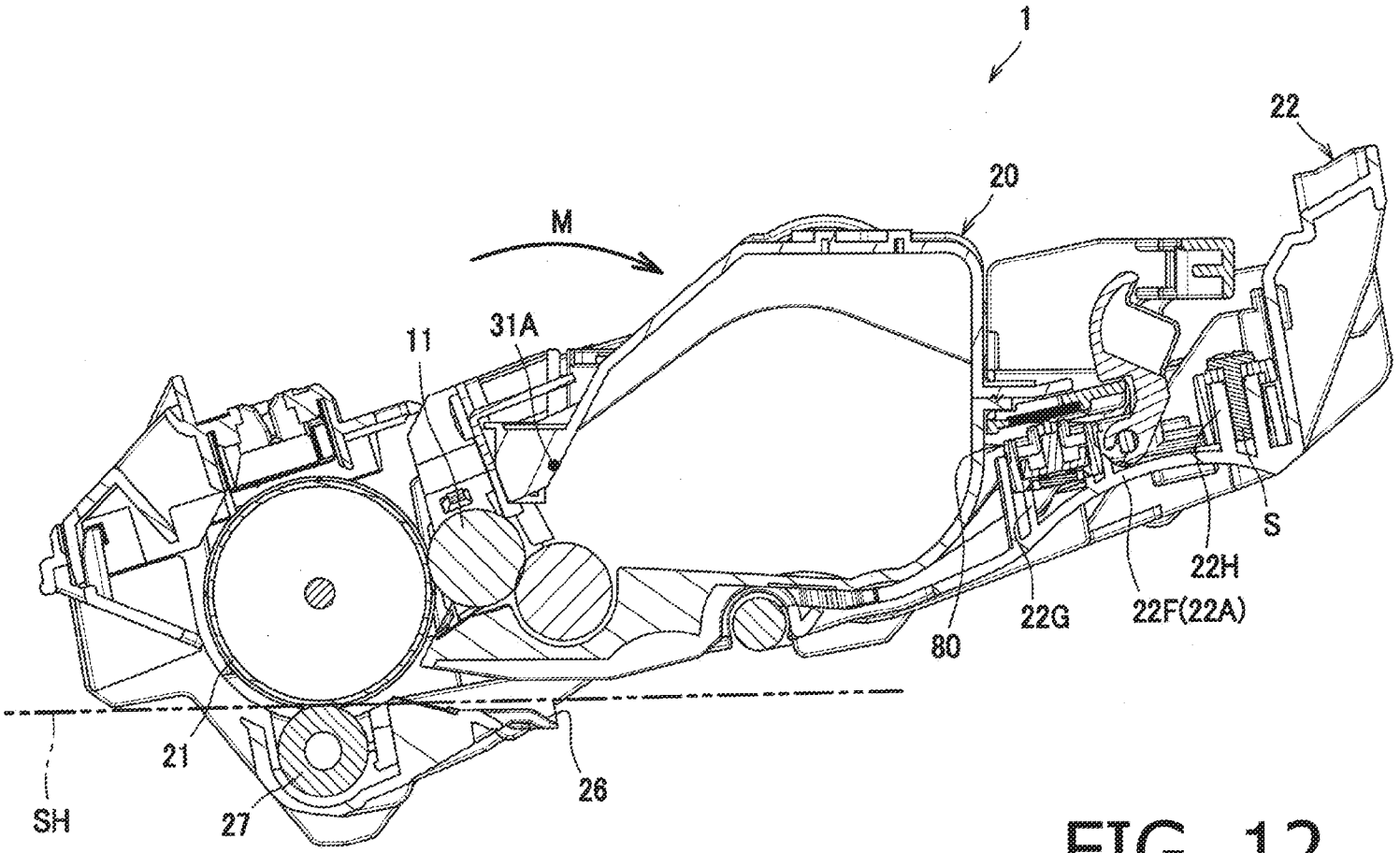
FIG. 12 is a cross-sectional view at a widthwise center of the process cartridge according to the embodiment of the present disclosure.

As shown in FIG. 12, the bottom wall 22A of the drum frame 22 includes a curved section 22F, which is curved upward in a cross-sectional shape of an arc. The holder 80 is arranged on the curved section 22F. Specifically, the holder 80 is supported by a plurality of ribs 22G and bosses 22H, which protrude upward from the curved section 22F. The crew S to fix the holder 80 to the drum frame 22 is fastened to the bosses 22H.

In a state where the process cartridge 1 is attached to the main body of the image forming apparatus, and in a case where the driving force is being input to the coupling 31 of the developer cartridge 10, a rotation moment M about an axis 31A of the coupling 31 can be produced. Therefore, when the driving force is being input, as shown in FIG. 13A, the electric contacts 42 can be urged against the first drum contacts 71A by the rotation moment M produced in the developer cartridge 10.

Meanwhile, urging force of the coil springs 74 (see also FIG. 10) in the spring-pin connector 70 can be smaller than an amount of pressure by the rotation moment M to urge the electric contacts 42 against the first drum contacts 71A. Specifically, a sum of the urging force from the plurality of coil springs 74 may be smaller than an amount of the pressure by the rotation moment M to urge the electric contacts 42 against the first drum contacts 71A. Therefore, when the driving force is being input, the electric contacts 42 push the pins 71, including the first drum contacts 71A, downward against the urging force of the coil springs 74. In the meantime, the engagement part 59 in the developer cartridge 10 is separated from the contact part 62A of the lock lever 60.

In a case where the lock lever 60 is in the locking position, the contact part 62A of the lock lever 60 is arranged along the pressing direction PD, in which the pressing member 23 (see also FIG. 7) presses the pressurized section 13. In the meantime, in a case where the lock lever 60 is in the locking position and the developer cartridge 10 is locked to the drum cartridge 20, the contact surfaces 42A of the electrical contacts 42 and the supporting part 56 are arranged extend along the pressing direction PD.

Further, in a case where the developer cartridge 10 is locked to the drum cartridge 20, the contact part 62A is located at a downstream position from the first drum contacts 71A with regard to a direction, in which the coil springs 74 (see also FIG. 10) urge the first drum contacts 71A. In the meantime, the contact part 62A is located at an opposite side of the supporting part 56 to the first drum contacts 71A. In other words, in a case where the developer cartridge 10 is locked to the drum cartridge 20, the contact part 62A is located at the opposite side of a hypothetical place, which contains the supporting part 56, to the first drum contacts 71A. Further, in a case where the developer cartridge 10 is locked to the drum cartridge 20, the contact part 62A is located at an opposite side of a hypothetical plane, which contains the first substrate 40, to the first drum contacts 71A.

On the other hand, when no substantial driving force is being input to the developer roller 11, as shown in FIG. 13B, the developer cartridge 10, or the engagement part 59 of the handle 50, is placed to contact the lock lever 60 by the urging force of the coil springs 74 (see also FIG. 10) in the spring-pin connector 70. In this state, meanwhile, the electric contacts 42 are in contact with the first drum contacts 71A.

Figure 14:
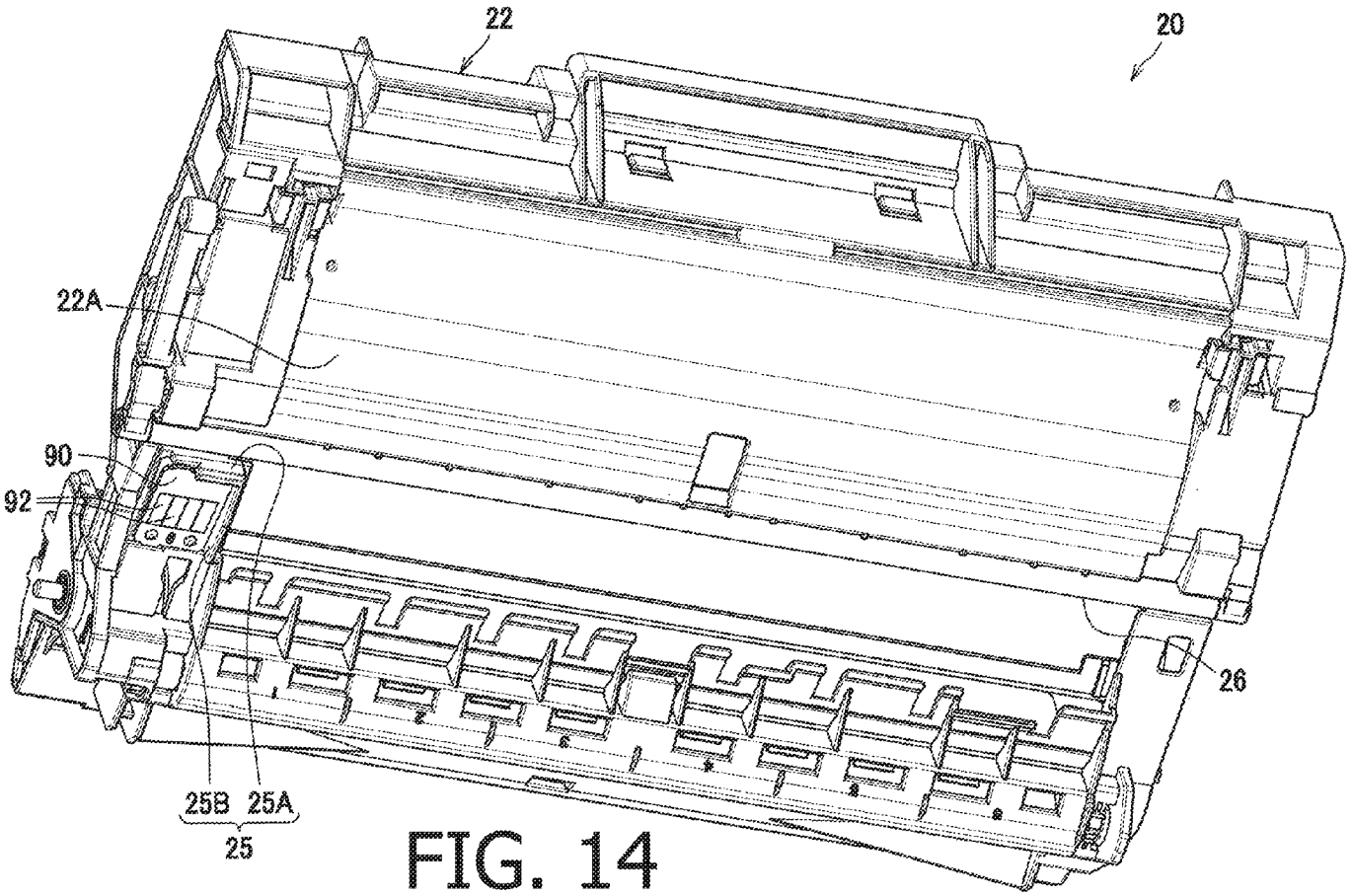
FIG. 14 is an upward perspective view of the drum cartridge according to the embodiment of the present disclosure.

As shown in FIG. 14, the drum cartridge 20 includes a second substrate 90, a rib 25, and an opening 26. The second substrate 90 includes a plurality of second drum contacts 92. The rib 25 extends along edges of the second substrate 90. The opening 26 is formed at a frontward position with respect to a center with regard to the front-rear direction of the bottom wall 22A of the drum frame 22, and the sheet SH (see also FIG. 12) being conveyed by the photosensitive drum 21 to have an image printed thereon may pass through the opening 26. In this regard, as shown in FIG. 12, the sheet SH may be conveyed between a transfer roller 27 and the photosensitive drum 21, which are arranged in the drum cartridge 20, along the front-rear direction. In other words, a direction to convey the sheet SH substantially coincides with the front-rear direction.

The second substrate 90 is arranged at a lower side of the bottom wall 22A of the drum frame 22. On an upper surface of the second substrate 90, arranged is a connector 91 (see also FIG. 15). On a lower surface of the second substrate 90, arranged are the second drum contacts 92. The connector 91 connects an end of a cable 320, which will be described later, with the second substrate 90.

The second drum contacts 92 may, in a case where the process cartridge 1 is attached to the main body of the image forming apparatus, establish contact with a contact terminal arranged in the main body. The contact terminal in the main body is connected with a controller arranged in the main body.

The second drum contacts 92 are located at positions displaced from the first drum contacts 71A (see also FIG. 9). The second drum contacts 92 are formed in shapes of rectangular thin bars and arranged to be slightly spaced apart from one another along the widthwise direction.

The rib 25 protrudes downward from the bottom wall 22A of the drum frame 22. In particular, the rib 25 protrudes to a position farther, or lower, than the second substrate 90. Further, the rib 25 protrudes to a position farther, or lower, than the second drum contacts 92. The rib 25 includes a first rib 25A extending longitudinally along the widthwise direction and a second rib 25B extending longitudinally along the front-rear direction, which is the direction to convey the sheet SH. The second rib 25B is located between the opening 26 and the second substrate 90.

Figure 15:
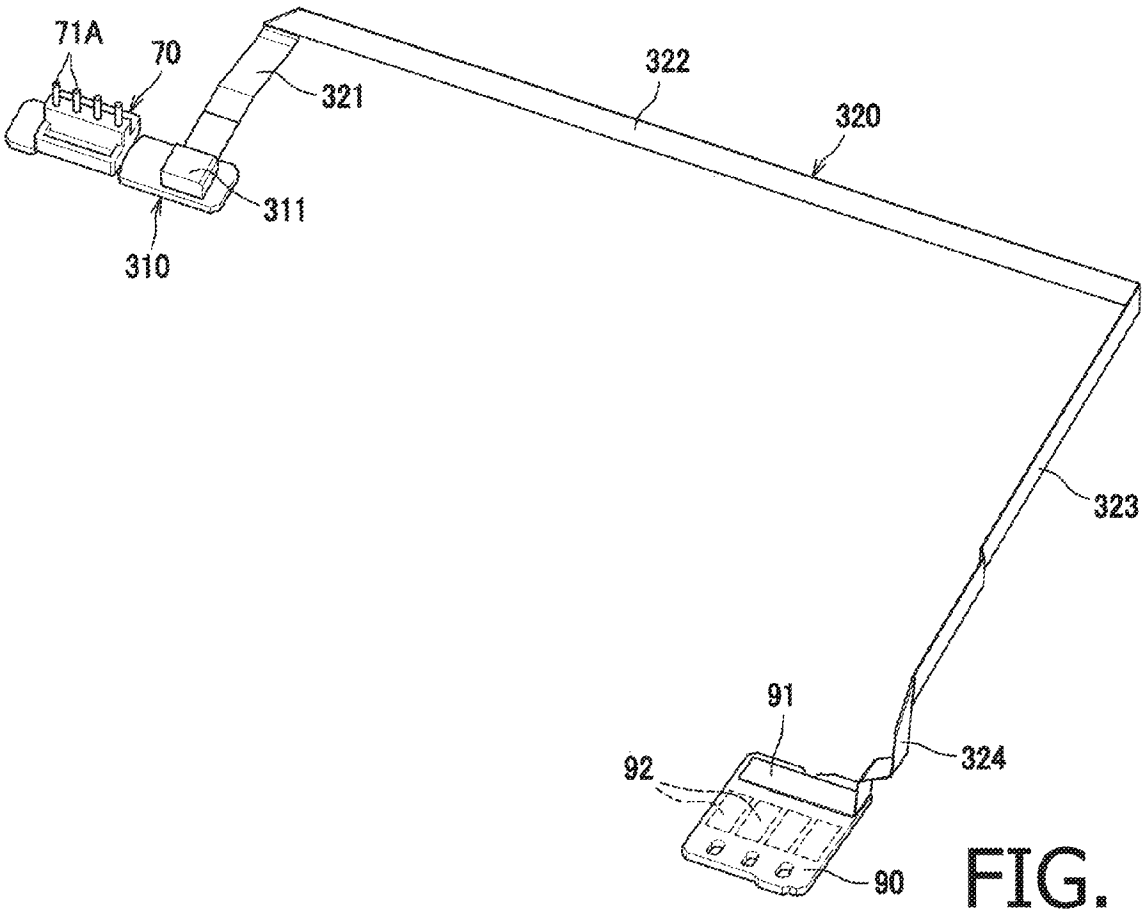
FIG. 15 is a perspective view of the spring-pin connector, a cable, and first and second substrates for the drum cartridge according to the embodiment of the present disclosure.

The drum cartridge 20 includes, further, as shown in FIG. 15, an intermediate substrate 310 and the cable 320, which connect the first drum contacts 71A in the spring-pin connector 70 with the second drum contacts 92 on the second substrate 90. The intermediate substrate 310 is arranged at a position lower than the spring-pin connector 70. The intermediate substrate 310 has a widthwise larger than a widthwise dimension of the spring-pin connector 70, and widthwise ends of the intermediate substrate 310 protrude outward with respect to the widthwise ends of the spring-pin connector 70. A connector 311 is arranged at an upper surface of the intermediate substrate 310.

The connector 311 aligns with the spring-pin connector 70 along the widthwise direction. The connector 311 is connected with the housings 73 in the spring-pin connector 70 through wires and contacts (not shown) that are arranged on the upper surface of the intermediate substrate 310.

One end of the cable 320 is connected with each of the first drum contacts 71A through the connector 311 on the intermediate substrate 310 and the items in the spring-pin connector 70. The other end of the cable 320 is connected with each of the second drum contacts 92 through the connector 91 and the wires on the second substrate 90. The cable 320 includes a first section 321, a second section 322, a third section 323, and a fourth section 324. The first section 321 extends rearward from the connector 311. The second section 322 extends from the first section 321 toward the one side, e.g., leftward, along the widthwise direction. The third section extends frontward from the second section 322. The fourth section 324 extends downward from the third section 323. The cable 320 may be a known flexible flat cable.

Figure 16:
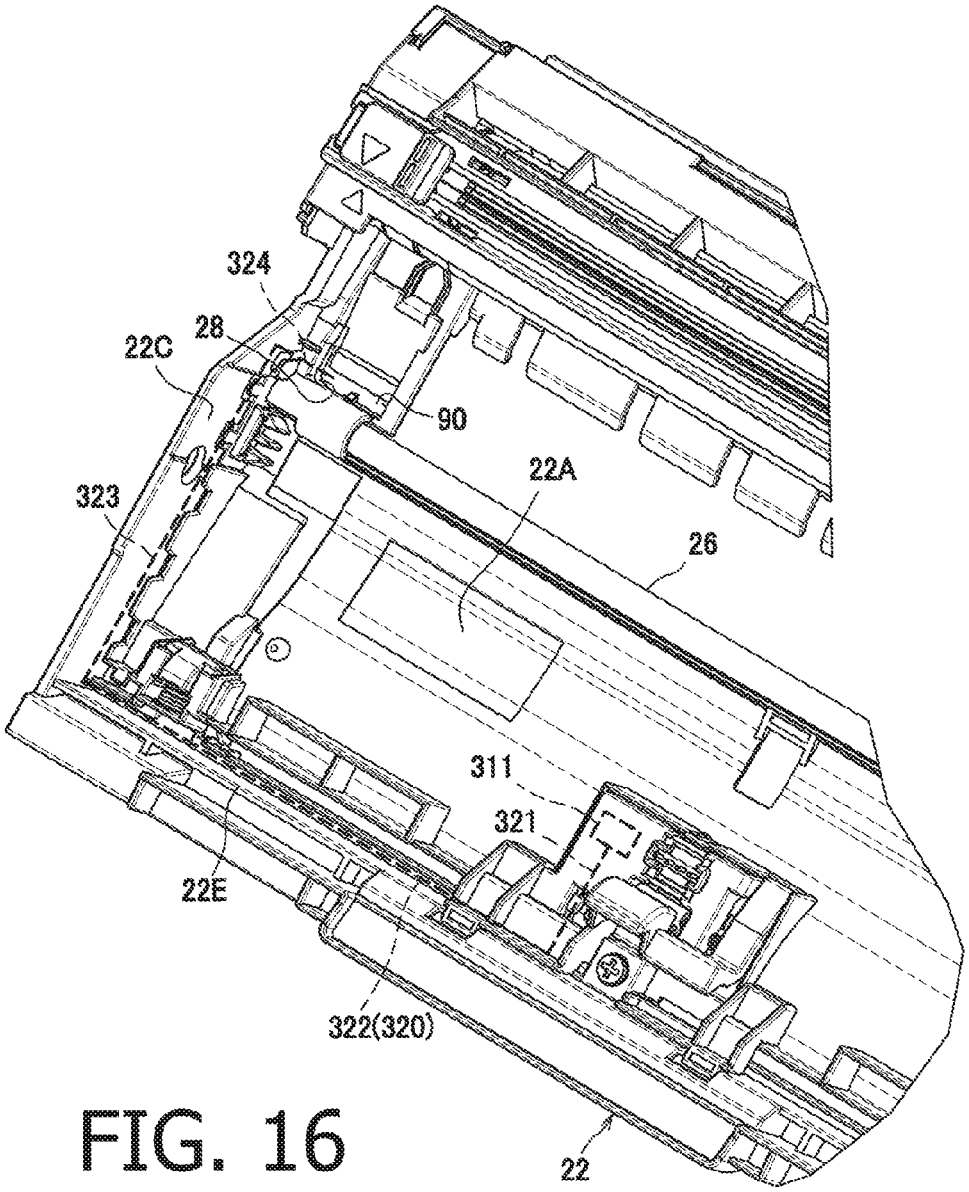
FIG. 16 is a perspective view to illustrate arrangement of the drum frame and the cable in the drum cartridge according to the embodiment of the present disclosure.

In particular, as shown in FIG. 16, the first section 321 extends from the connector 311 through the holder 80 to the side wall 22E, which is at the rearward side of the drum frame 22, and the second section 322 extends along the side wall 22E. In this regard, the side wall 22E on the rear side supports the second section 322. The third section 323 extends along the side wall 22C on the left. In this regard, the side wall 22C on the left supports the third section 323.

The fourth section 324 extends along the side wall 22C on the left. The fourth section 324 extends through a hole 28 formed in the bottom wall 22A and connected with the connector 91 (see also FIG. 15) on the second substrate 90.

According to the present disclosure, the drum cartridge 20 with the developer cartridge 10 attached and locked thereto may form the process cartridge 1. The process cartridge 1 including the developer cartridge 10 and the drum cartridge 20 may be attached to the main body of the image forming apparatus. Bellow will be described benefits achievable by the process cartridge 1 with the drum cartridge 20 according to the embodiment of the present disclosure.

As shown in FIG. 13B, in the state where the process cartridge 1 is attached to the main body, and in a case where no substantial driving force is input to the developer roller 11, the engagement part 59 in the developer cartridge 10 may be pushed upward by the urging force of the coil springs 74 in the spring-pin connector 70 and contact the contact part 62A of the lock lever 60. In other words, while the engagement part 59 in the developer cartridge 10 may tend to move upward due to the urging force of the coil springs 74, the engagement part 59 is restricted by the contact part 62A in the lock lever 60 from moving further upward. Therefore, while the lock lever 60 locks the developer cartridge 10 to the drum cartridge 20, the first drum contacts 71A may be pushed by the urging force of the coil springs 74 against the electric contacts 42. Thereby, the first drum contacts 71A may tightly contact the electric contacts 42. In other words, the contact between the first drum contacts 71A and the electric contacts 42 may be maintained preferably.

In the meantime, in this state where the developer cartridge 10 is locked to the drum cartridge 20, the contact part 62A is located at the downstream position from the first drum contacts 71A with regard to the direction, in which the coil springs 74 in the spring-pin connector 70 urge the first drum contacts 71A, or the pins 71. Therefore, the urging force of the coil springs 74 may be transmitted to the contact part 62A preferably.

On the other hand, as shown in FIG. 13A, in a case where the driving force is input to the developer roller 11, due to the rotation moment M produced in the developer cartridge 10, the electric contacts 42 may push the first drum contacts 71A downward against the urging force of the coil springs 74. Accordingly, the engagement part 59 in the developer cartridge 10 may be separated from the lock lever 60. In other words, the engagement part 59 may be released from the lock lever 60. Therefore, the developer cartridge 10 may be pressed by the presser member 23 (see also FIG. 7) effectively without being interfered by friction force that may otherwise be caused between the engagement part 59 and the lock lever 60.

In the meantime, the contact part 62A in the lock lever 60 extends along the pressing direction PD for the presser member 23; therefore, the developer cartridge 10 may move along the pressing direction PD smoothly. In particular, a surface of the engagement part 59 that confronts the contact part 62A extends likewise along the pressing direction PD; therefore, the movability of the developer cartridge 10 in the pressing direction PD may be improved.

Further, the contact surfaces 42A of the electric contacts 42 extend likewise along the pressing direction PD; therefore, the movability of the developer cartridge 10 in the pressing direction PD may be improved even more.

Moreover, the following benefits may be achievable by the present disclosure.

As shown in FIG. 11, the first drum contacts 71A are located within the width range B1 of the contact part 62A; therefore, the urging force of the coil springs 74 may be effectively transmitted to the contact part 62A of the lock lever 60. For example, some of the first drum contacts 71A may be located outside the width range B1 of the contact part 62A, and the engagement part 59 may be elongated longer in the widthwise direction to cover the entire first drum contacts 71A. In such a configuration, however, the developer cartridge 10 may tend to tilt about a position, where the developer cartridge 10 contacts the contact part 62A. In this regard, according to the present disclosure, the developer cartridge 10 may be prevented from tilting.

As shown in FIG. 6, the presser members 23 are each arranged at the one end side and the other end side with regard to the widthwise direction of the drum cartridge 20 while the spring-pin connector 70 including the first drum contacts 71A is arranged at the widthwise central area. Therefore, for example, compared to a configuration, in which the spring-pin connector 70 is located at a position displaced from the widthwise central area, the developer cartridge 10 may be restricted from tilting in the front-rear direction at the widthwise end portions in a case where the presser members 23 press the developer cartridge 10.

As shown in FIG. 12, the holder 80 is placed on the curved section 22F, which may be relatively intense within the bottom wall 22A in the drum frame 22. Therefore, deformation of the holder 80 may be prevented, and the contact between the first drum contacts 71A and the electric contact 42 may be securely maintained.

As shown in FIG. 14, with the rib 25 protruding downward from the bottom wall 22A of the drum frame 22 to the position lower than the second substrate 90, the second drum contacts 92 may be protected by the rib 25 from being damaged.

Further, with the second rib 25B arranged between the opening 26 and the second substrate 90, while the sheet SH being conveyed through the opening 26 may carry dust thereon, the dust may be prevented from being transferred to the second substrate 90.

The first substrate 40 is arranged at the handle 50, which is detachably attached to the frame body 121. Therefore, the first substrate 40 may be replaced with a new first substrate 40 together with the handle 50 easily.

Although an example of carrying out the invention has been described, those skilled in the art will appreciate that there are numerous variations and permutations of the drum cartridge for an image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

Below will be described examples derivable from the embodiment described above. In the following examples, items or structures which are substantially the same as or similar to those described in the above embodiment may be denoted by the same reference signs, and description of those may be omitted.

Figure 17A:
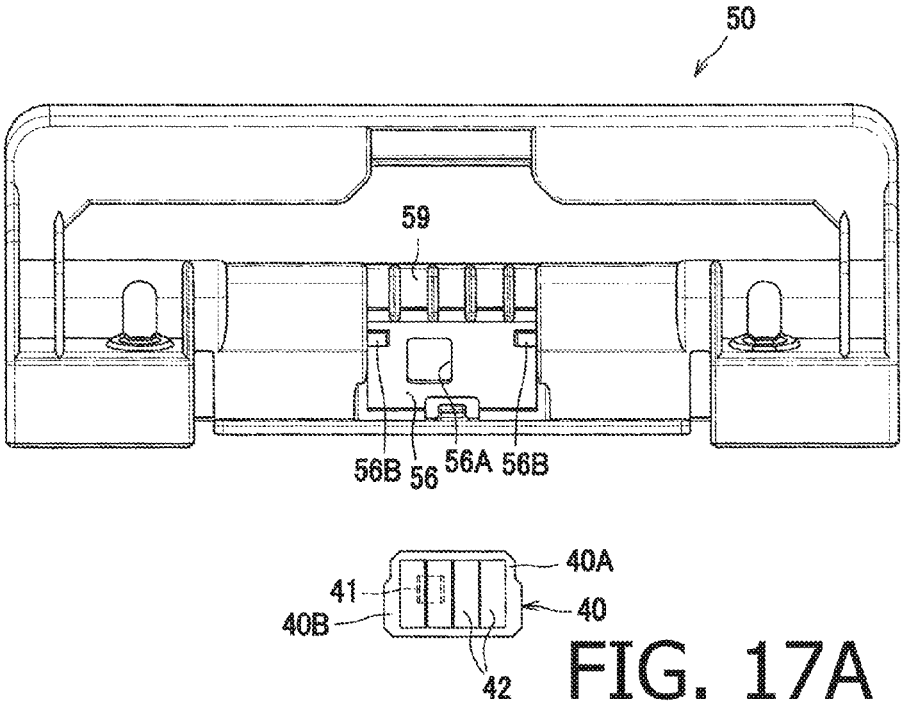
FIG. 17A is a bottom plan view of a handle in a modified example of the embodiment of the present disclosure.
Figure 17B:
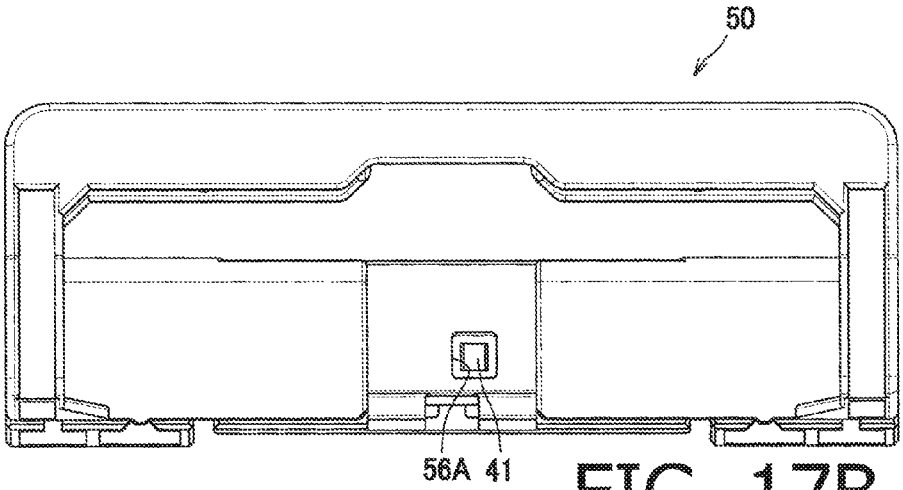
FIG. 17B is a top plan view of the handle in the modified example of the embodiment of the present disclosure.

For example, the chip 41 may not necessarily be located at the widthwise central area on the first substrate 40 but may be located at a position displaced from the widthwise center of the first substrate 40 along the widthwise direction, as show in FIGS. 17A-17B. In this regard, the opening 56A may be formed at a position likewise displaced from the widthwise center of the supporting part 56. With this arrangement, if a worker incorrectly attempts to attach the first substrate 40 to the supporting part 56 in the contrary orientation, the chip 41 may conflict with the supporting part 56, and the worker may recognize the incorrect orientation of the first supporting part 40 promptly.

For another example, the forms of the electric contacts 42 and the first drum contacts 71A may not necessarily be limited to the thin bars with surfaces and the pins 71 pointing tips. For example, the electric contacts 42 may be in pointing pin-shapes while the first drum contacts 71A may be in spreading bar-shapes with surfaces. Further, the second drum contacts 92 may as well be formed in another shape.

For another example, the coil springs 74 may be replaced with torsion springs or blade springs.

For another example, an amount of the urging force of the coil springs 74 or any other springs may be equal to or larger than the amount of the pressure to the electric contact 42 against the first drum contacts 71A due to the rotation moment. In this exemplary configuration, the developer cartridge 10 may contact the lock lever 60 when the driving force is being input to the developer roller 11.

Moreover, parts, items, or structure that have been described in the previous embodiment and/or the varied examples may be arbitrarily combined depending on individual discretion or preferences.

What is claimed is:

1. A drum cartridge, to which a developer cartridge is detachably attached, the developer cartridge being configured to contain toner therein and comprising a memory medium including an electric contact, the drum cartridge comprising:

a photosensitive drum;

a drum frame configured to receive the developer cartridge;

a lock lever configured to lock the developer cartridge to the drum frame;

a first drum contact configured to be in contact with the electric contact in a state where the developer cartridge is locked to the drum frame; and a spring configured to urge the first drum contact toward the electric contact, wherein, in the state where the developer cartridge is locked to the drum frame, the first drum contact is pressed toward the electric contact by an urging force of the spring.

2. The drum cartridge according to claim 1, wherein, in the state where the developer cartridge is locked to the drum frame, and in a case where a driving force is input to the developer cartridge, the electric contact is pressed against the first drum contact by a rotation moment produced in the developer cartridge due to the driving force.

3. The drum cartridge according to claim 2, wherein an amount of the urging force of the spring is smaller than an amount of pressure by the rotation moment that presses the electric contact toward the first drum contact.

4. The drum cartridge according to claim 3, wherein, in a case where no driving force is input to the developer cartridge, the lock lever is in contact with the developer cartridge; and wherein, in a case where the driving force is input to the developer cartridge, the lock lever is separated from the developer cartridge.

5. The drum cartridge according to claim 1, further comprising:

a presser member configured to press the developer cartridge toward the photosensitive drum along a pressing direction in the state where the developer cartridge is locked to the drum frame, wherein the lock lever comprises a contact part, at which the lock lever contacts the developer cartridge in the state where the developer cartridge is locked to the drum frame, the contact part extending along the pressing direction.

6. The drum cartridge according to claim 5, wherein the first drum contact is located within a width range of the contact part in a direction of an axis of the photosensitive drum.

7. The drum cartridge according to claim 5, wherein the contact part is located at a position downstream from the first drum contact in a direction, in which the spring urges the first drum contact.

8. The drum cartridge according to claim 5, wherein the developer cartridge further comprises a supporting part supporting the memory medium; and wherein the contact part is located at a side of the supporting part opposite to the first drum contact in the state where the developer cartridge is locked to the drum frame.

9. The drum cartridge according to claim 5, wherein the presser member is arranged at both one end and the other end opposite from the one end of the drum frame in a direction of an axis of the photosensitive drum; and wherein the first drum contact is arranged in a central area in the drum frame in the direction of the axis of the photosensitive drum.

10. The drum cartridge according to claim 1, wherein the lock lever comprises a contact part, at which the lock lever is in contact with the developer cartridge in the state where the developer cartridge is locked to the drum frame; and wherein the contact part is located at a position downstream from the first drum contact in a direction, in which the spring urges the first drum contact.

11. The drum cartridge according to claim 1, wherein the lock lever comprises a contact part, at which the lock lever is in contact with the developer cartridge in the state where the developer cartridge is locked to the drum frame;

wherein the developer cartridge further comprises a supporting part supporting the memory medium; and wherein the contact part is located at a side of the supporting part opposite to the first drum contact in the state where the developer cartridge is locked to the drum frame.

12. The drum cartridge according to claim 1, wherein the drum cartridge comprises a holder configured to support the lock lever pivotably; and wherein the holder comprises a hole, through which the first drum contact is exposed.

13. The drum cartridge according to claim 12, wherein a bottom wall of the drum frame comprises a curved section; and wherein the holder is arranged on the curved section.

14. The drum cartridge according to claim 1, further comprising:

a second drum contact configured to be in contact with a contact terminal of an image forming apparatus, to which the drum cartridge is attachable, the second drum contact being located at a position displaced from the first drum contact; and a cable connecting the first drum contact with the second drum contact.

15. The drum cartridge according to claim 14, wherein a side wall of the drum frame supports the cable.

16. The drum cartridge according to claim 14, further comprising:

a substrate comprising the second drum contact; and a rib extending along an edge of the substrate, wherein the rib protrudes farther than the substrate.

17. The drum cartridge according to claim 16, wherein the rib comprises a first rib extending along a direction of an axis of the photosensitive drum and a second rib extending along a conveyance direction, in which a sheet is conveyed by the photosensitive drum.

18. The drum cartridge according to claim 17, wherein the drum frame has an opening, through which the sheet is conveyed; and wherein the second rib is located between the opening and the substrate.

19. The drum cartridge according to claim 1, wherein the drum frame comprises one end side, at which the photosensitive drum is located, and the other end side opposite to the one end side; and wherein the lock lever is located at the other end side of the drum frame.

* * * * *